US010533752B2

(12) United States Patent
Faraldi et al.

(10) Patent No.: US 10,533,752 B2
(45) Date of Patent: Jan. 14, 2020

(54) FLUID SUPPLY FOR A HOUSEHOLD APPLIANCE AND HOUSEHOLD APPLIANCE

(71) Applicant: Electrolux Appliances Aktiebolag, Stockholm (SE)

(72) Inventors: Paolo Faraldi, Forli (IT); Lorenzo Gattei, Forli (IT); Nicola Guida, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 599 days.

(21) Appl. No.: 15/032,539

(22) PCT Filed: Jan. 5, 2015

(86) PCT No.: PCT/EP2015/050033
§ 371 (c)(1),
(2) Date: Apr. 27, 2016

(87) PCT Pub. No.: WO2015/106978
PCT Pub. Date: Jul. 23, 2015

(65) Prior Publication Data

US 2016/0265789 A1 Sep. 15, 2016

(30) Foreign Application Priority Data

Jan. 15, 2014 (EP) ..... 14151205

(51) Int. Cl.
*F24C 15/00* (2006.01)

(52) U.S. Cl.
CPC ..... *F24C 15/003* (2013.01)

(58) Field of Classification Search
CPC .... A47L 15/4418; D06F 39/02; F24C 15/003; F24C 15/327; A23B 7/144; A21B 3/04
USPC ..... 219/401; 99/403, 467, 468, 473, 474; 134/93, 56 R, 57 D, 99.2; 137/268, 574
See application file for complete search history.

(56) References Cited

U.S. PATENT DOCUMENTS

| | | | | |
|---|---|---|---|---|
| 6,972,397 | B2 | 12/2005 | Ha | |
| 2005/0097925 | A1 | 5/2005 | Kim et al. | |
| 2006/0278630 | A1 | 12/2006 | Sun et al. | |
| 2007/0215592 | A1 | 9/2007 | Wang | |
| 2011/0266272 | A1* | 11/2011 | Colburn | H05B 3/60 219/401 |

FOREIGN PATENT DOCUMENTS

| | | | |
|---|---|---|---|
| DE | 102004024892 | A1 | 12/2005 |
| DE | 102011088482 | A1 | 6/2013 |

(Continued)

OTHER PUBLICATIONS

International Search Report issued in PCT/EP2015/050033 dated Feb. 18, 2015, 3 pages.

*Primary Examiner* — Dana Ross
*Assistant Examiner* — James F Sims, III
(74) *Attorney, Agent, or Firm* — Pearne & Gordon LLP

(57) ABSTRACT

The invention describes a fluid supply (100) for a household appliance especially a steam oven (200) that has improved cleaning and hygienic characteristics. A wave breaker structure (120) is removably included inside a removable fluid container (110) and can be completely separated from it for cleaning purposes. The fluid container (110) is preferably releasable having a valve (115) and being mounted inside of a steam oven (200).

11 Claims, 2 Drawing Sheets

(56) References Cited

FOREIGN PATENT DOCUMENTS

| | | | |
|---|---|---|---|
| FR | 2427421 | A1 | 12/1979 |
| JP | 2008025895 | A | 2/2008 |
| KR | 20090107850 | A | 10/2009 |
| WO | 2010125538 | A1 | 11/2010 |

* cited by examiner

FLUID SUPPLY FOR A HOUSEHOLD APPLIANCE AND HOUSEHOLD APPLIANCE

Modern household appliances often require operating fluids such as detergents or water to perform their function. Depending on their field of operation, larger or smaller amounts of operating fluids may be required. In cafeterias, for instance, espresso machines are directly connected by a plumbed water connection and thus allow large quantities of water as an operating fluid to be provided instantaneously. Other conceivable solutions are fixed tanks with an opening built inside of the household appliance that can be filled with an operating fluid from outside.

Further, solutions are known from dishwasher machines where the cleansing agent is stored in a fixedly inbuilt supply tank. Another conceivable solution for a fluid supply is a removable fluid supply tank. It has the advantage that excess supply fluid can be disposed of after the use of the household appliance and that the fluid supply tank can easily be cleaned and kept in a hygienic state.

Considering water as an operating fluid and in combination with food, often strict hygienic regulations need to be followed. In this case, considering particularly steam ovens, a fixed tank with a water intake port comprises a solution that is meant for basically an entry level steam oven and commonly used there. The water loading usually has to be performed directly at the household appliance by using a separate tool like a jug or a bottle and the storage takes place in a hidden compartment with potential hygienic concerns.

The amount of available water and overfilling are also possible issues that are of concern to a user. A plumbed water connection on the other hand as an alternative is a solution that is typically used for top shelf steam ovens in terms of household appliances. In this case, the water loading happens on demand, which requires no user interaction. Then however, safety precautions in terms of e.g. providing a safety valve need to be taken in order to avoid flooding of the appliance environment in case of a malfunction. Further, a water connection is required in the proximity of the oven.

Another potentially considerable alternative is a removable water tank. Such a solution is e.g. meant for high-end household appliances, e.g. steam ovens. In this case, water is loaded into a removable water container, which preferably is integrated in the oven body. The water loading can happen wherever the user desires according to his convenience and even directly under the water tap. Once the water supply tank is replaced into the oven, preferably a quick lock connector may ensure that the water can be supplied to the household appliance, e.g. a steam generator.

In terms of usability and hygiene, such a solution can be considered as an optimum, as the water storage occurs in a fully accessible and conveniently cleanable device. A typical volume of such a water supply tank for a steam oven may be approximately 1 liter. This fluid amount may, however, not be considered limiting in any sense. Observations have been made that cooking a meal in a normal household does not require much more water. However, there may be household appliances that require more fluid which can be accommodated in a larger fluid supply container. Further, considerations may play a role with reference to the weight of the fluid container that needs to be transported and inserted into the household appliance. A weight of approximately 1 kg can easily be maneuvered also by weaker persons and consequently presents no obstacle in using the household appliance.

Removable fluid supply containers, in particular so-called removable water drawers which have a generally flat and longitudinally extended shape, pose the risk of fluid spillage during transport. During transport, the fluid may be agitated causing waves to be formed inside the container, which may run over the border of the container. It is therefore desired to restrict or limit the movement of fluid inside the fluid supply container, in particular in a front-to back direction inside a removable water drawer. As a typical volume is approximately 1 liter, the handling of the full tank is potentially difficult, especially if in its shape width dominates over height. Moreover, it is mostly annoying when the fluid inside the tank unbalances the container and gets spilled.

It is therefore desired to add features inside of the tank volume creating partitions of it and breaking the free wave path in short segments. Such features are commonly referred to as wave breakers.

Prior art document DE 102004024892 A1 discusses a fluid container. This fluid container has a splash protection device in the form of barriers that form a part of a cover of the fluid container.

Document DE 102010002532 A1 discusses a household appliance, especially a cooking appliance as well as a supply container. A supply container shown there in FIG. 5 contains splash protection barriers that are coupled to the bottom plane of the container. Such a container is said to be easily cleanable. In said prior art the barriers are formed in one piece with the container or container lid by molding of a plastics material. Now it has been observed by the present inventors that the formation of said barriers add to an undesirable extent to the complexity of the molding tools for the container or for the container lid, respectively, thus unduly increasing the costs of the manufacture of said molding tools.

No further related prior art is known.

It is an object of the present invention to provide a fluid supply for a household appliance and a household appliance that improve the cleanability and the hygienic conditions in comparison to the known prior art and that can be produced in a simpler way.

This object is solved by a fluid supply for a household appliance according to claim 1 and a steam oven according to claim 15.

Further developments of the invention are given in the dependent claims.

In a beneficial manner, the fluid supply according to an embodiment of the present invention comprises a fluid container, a fluid communication part and an obstacle to obstruct a fluid current supported inside of the fluid container. In this manner, the obstacle can be completely removed from the container, leaving a smooth surface that can be easily and completely cleaned in a hygienic manner.

Beneficially, according to a further development of an embodiment of the present invention, the fluid supply features a releasable container. In this manner, the container can easily be removed from the household appliance and rinsed and cleaned under the water tap or put into a dishwasher.

Advantageously, a fluid supply according to a further development of the present invention comprises a fluid container having a removable lid. Such a removable lid in an advantageous manner further facilitates the easy cleaning of the fluid container.

Advantageously, a further development of the fluid supply according to the present invention comprises a fluid container and a lid which have mutually interacting guides aligned for providing drawer movement. In this manner, the fluid container can easily be opened, while at the same time featuring a safe connection between the lid and the container securely additionally avoiding spillage of fluid during movement of the container.

Advantageously, the outside of the container can further provide guides that interact with corresponding guides in the household appliance to provide for a drawer movement. In this respect a groove can be provided as a guide.

Further, beneficially, a further development of a fluid supply according to the present invention has a lid comprising an opening for filling the fluid container. In this manner, the lid has not always to be removed from the fluid container once a refill is desired by the user. In alternative, an opening for filling the fluid container can be provided in the fluid container itself, in particular in a top wall of the fluid container, especially in a region of the top wall that is adjacent to the removable lid.

Beneficially, according to a further development of the fluid supply of the present invention, the obstacle is supported on the bottom floor plane of the fluid container. In an advantageous manner, the obstacle is thus supported by gravity and needs no further support structure to prevent its movement inside of the fluid container.

Favorably, according to a further development, the fluid supply according to the present invention comprises an obstacle that is supported by a sidewall of the container, e.g. by a nose or a hook or a notch. Advantageously, in this manner, the obstacle can be hovering above the floor of the container to allow fluid to pass around it.

Beneficially, according to a further development, the obstacle in a fluid container of the instant invention may be supported on a guide, which can be beneficially provided in the form of a notch or an indentation or a mutual engaging notch and an indentation.

Beneficially, according to a further development of the fluid supply of the present invention, the obstacle is comprised of plural interconnected parts. Advantageously obstacles may be arranged serially to maximize the wave breaking effect. In this way, a structure can be provided that in combination with the shape of the fluid container may provide an optimum disruption of waves in the fluid container as the obstacles can be arranged in an optimized fixed positional relationship to each other regarding fluid dynamics and be supported by the interconnecting structure.

Beneficially, according to a further development, the plural obstacles according to an embodiment of the present invention are held by a frame. Beneficially, such a frame is easy to be manufactured, and e.g. by injection-molding, the whole structure can be manufactured in one piece.

Beneficially, according to a further development of the fluid supply of the present invention, the obstacle is provided in the form of a wave breaker that disrupts waves forming in the fluid container while at the same time allowing fluid movement by the obstacle, e.g. around the side or passing fluid underneath or therethrough by slots or holes.

Beneficially, according to a further development of the fluid supply of the instant invention, the fluid container comprises at least a curved wall structure, which beneficially enhances the stability of the container while not requiring excessive material during manufacture. At the same time with the added stability the chance of wave-forming due to an instable container is reduced.

Beneficially, according to a further development of the fluid supply according to the present invention, the fluid container comprises an elongated shape. Having such a shape the fluid container beneficially can easily be inserted in a slot provided in the household appliance being longitudinally or transversally arranged. This allows for an optimum space economy in the household appliance.

Beneficially, the fluid container of the fluid supply according to an embodiment of the present invention may have a shape that concentrates fluid inside the container in a direction towards the fluid communication part. In this manner, it is beneficially ensured that almost all of the fluid inside of the container can be used during the operation of the household appliance, and the necessity of a refill during operation is avoided as much as possible.

Advantageously, the steam oven according to the present invention comprises a fluid supply according to the present invention that is releasably mounted inside of it.

Subsequently, examples and embodiments of the invention will be further explained on the basis of the drawings wherein.

Figure 1:
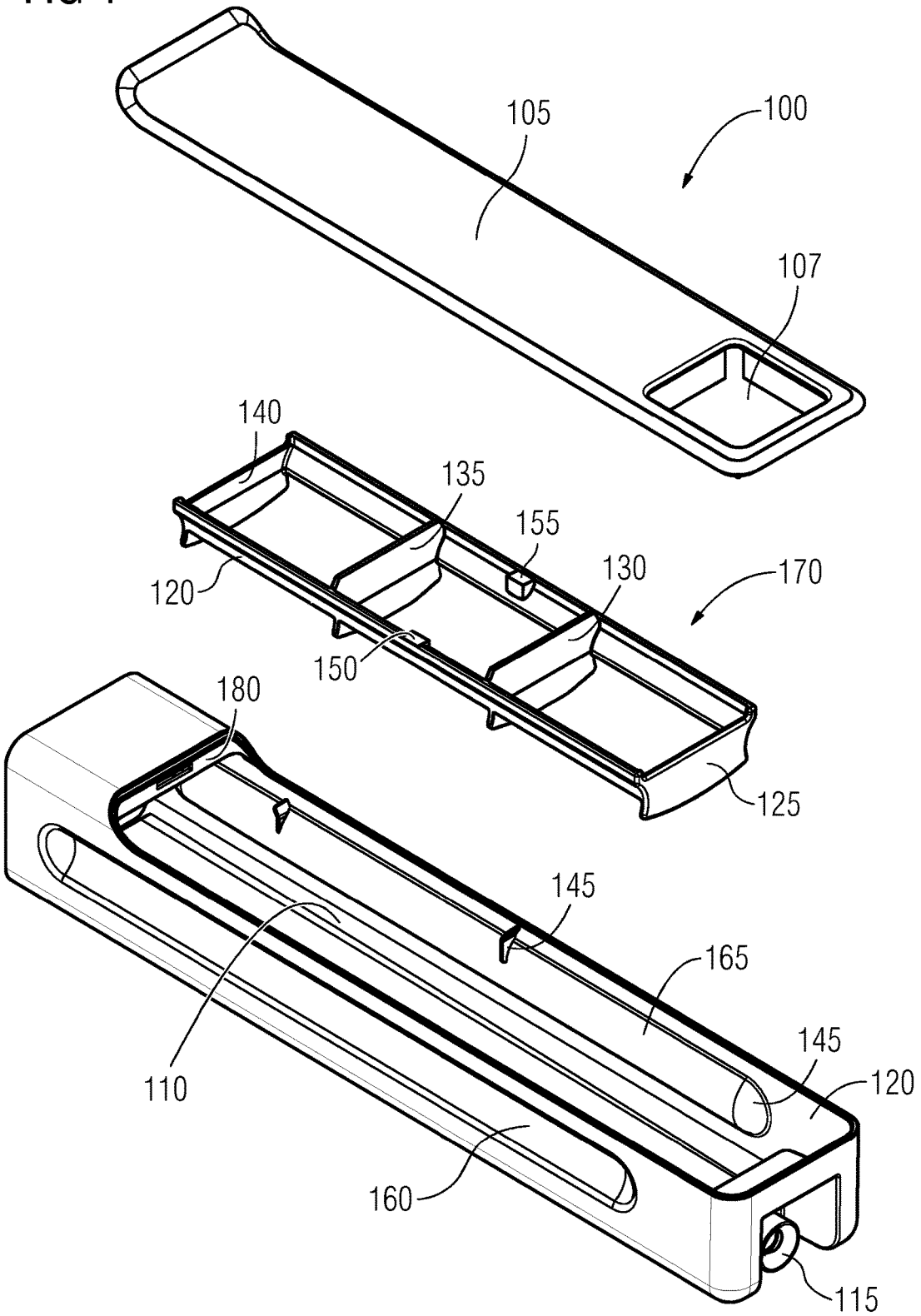
FIG. 1 shows a fluid container according to an embodiment of the present invention.

As FIG. 1 shows, an example of a fluid supply 100 for a household appliance as a preferred embodiment is represented in the form of a fluid container 110. The term "container" in the subsequent passages is used a s a general reference and intended to include the term "tank". It comprises a main body 120 in an elongated shape. In this case, the main body has curved sidewalls 160 and 165 that provide rigid stability for the elongated structure.

Beneficially a concave/convex groove/protrusion 160, 165 is formed in the forward to backward direction of at least one side wall of the main body. The structures 160, 165 may beneficially serve as a guide for guiding the main body in form of a drawer 100 inside a receiving opening 101 of a household appliance shown in FIG. 2. Further they may serve as a handle structure for inserting the thumb and the other fingers of a user hand inside opposing grooves.

The main body may be suitable to contain liquid up to the volume of 1 liter or more in sufficient quantity to provide a steam oven with enough liquid to prepare a meal without requiring an intermittent refill.

As can be further recognized in FIG. 1, the fluid supply 100 according to the present invention comprises a lid 105. The lid 105, as can be further deduced from the drawing, is e.g. not extending over the total length of the main body of the fluid supply container 110. Here at an inclined end wall 180, the lid comprises an inclination which matches one 180 at the main body of the fluid container 110. In the closed state, the inclination at the lid 105 may extend slightly over the contour of the fluid container 110 in order to facilitate an opening and a closing action of the lid as required to perform a cleaning activity and in order to insert and/or remove objects inside or from the fluid tank. It can then better be used as handle for opening the lid 105. Further, an opening 107 in the lid 105 is shown in FIG. 1, which allows a filling of the fluid container while the lid 105 is closed. In an alternative embodiment (not shown) of the fluid container which comprises a relatively smaller lid, an opening for filling may be provided in the top wall of the container itself.

In order to avoid waves to be formed inside of the main body of the fluid container 110 according to the present invention, obstacles may be inserted inside the interior volume of the fluid container. Beneficially obstacles may be grouped in a releasable obstacle structure 170. One or plural obstacles may be inserted inside of the fluid container 110 in order to disrupt waves in their path in the longitudinal direction of the fluid container 110. In this case, plural wave barriers 125, 130, 135 and 140 are shown that are held by a frame 120. The wave barriers beneficially work to obstruct a flow of the fluid. Such a support structure in combination with wave breakers may be manufactured by injection molding in a single piece and is thus lightweight and does not require much space from the volume of the fluid container, e.g. insignificantly reduces the fluid amount that can be held inside the fluid container because such a structure can be built lightweight and rigid with flat components.

A notch or an indentation 145 is shown which corresponds to a notch or indentation 155, 150 on the frame 120. In this manner, the frame 120 or an obstacle may be supported fixedly inside of the fluid container 110. On the other e.g. opposite side of the notch or indentation 145, there may be provided a second guide for the frame, which is not shown in the figure.

As an alternative, the wave breakers 125, 130, 135 and 140 may be releasably fixed in the frame 120. This allows the wave-breaking obstacle to be adapted to different fluids.

Depending on the viscosity of the fluid inside of the fluid container 110, a certain number of wave breakers may be required. That number can be e.g. reduced for a thicker fluid. Also a different shape of an obstacle may be of advantage in some application cases.

The fluid supply according to the present invention can be assembled by firstly inserting the frame 120 with the wave breakers 125 to 140 inside of the main body of the fluid container 110 while then sliding the drawer lid 105 on top of the fluid container sealing the fluid container 110 and fixing the obstacle inside of the container. Then, fluid may be filled through opening 107 into the fluid container 110.

In a subsequent step, the fluid supply may be completed by inserting the fluid container 110 inside of a steam oven, or in case of a different household appliance in this respective appliance.

By doing this, the fluid communication part 115 may engage a corresponding valve part inside of the household appliance, and when being mutually engaged, the fluid inside of the container may be allowed to enter the household appliance, the mutually engaging part of the household appliance and the fluid container 110 comprising the part 115 forming a sealed connection.

In FIG. 1, the fluid supply is shown to have e.g a 90% rectangular cross-section completed by rounded edges.

According to the requirements of the household appliance, the fluid container 110 may also have a circular or an ellipsoidal cross-section. Further, the bottom plane may not be parallel to the lid 105, but may be inclined at a certain angle to ensure that the fluid is collected in the area of the fluid communication part 115 to allow the functioning of the household appliance while still only a minimum amount of fluid is held inside of a fluid container 110.

In its exemplary case, the fluid container 110 is designed to be inserted along the longitudinal direction inside of a household appliance, and when completely inserted, forming a fluid connection with fluid communication part 115 with a household appliance. Commonly such an implementation can be referred to as a drawer. The container and a corresponding household appliance may be equipped with matching guides especially involving a groove to facilitate insertion and removal of the container in and out of the household appliance.

On the other hand, it may also be designed to be inserted along its shorter axis inside of the household appliance. In this manner, the movement for completing the insertion of the fluid container 110 is very short, and the risk of generating waves while moving the fluid container 110 is avoided as much as possible.

Figure 2:
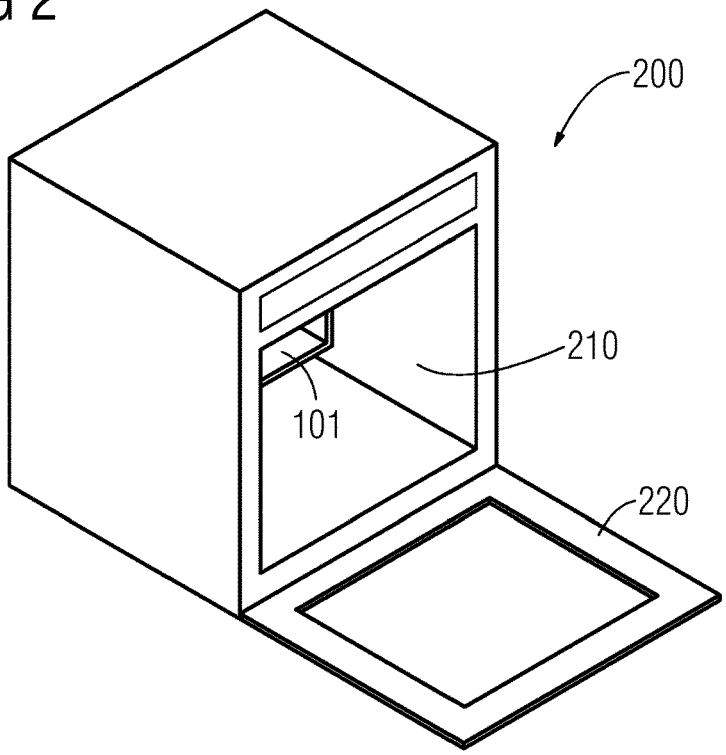
FIG. 2 shows an example of a household appliance in the form of a steam oven showing a potential receiving opening for a fluid container.

In the fluid supply 100 the lid 105 and the fluid container 110 beneficially together form a fluid drawer which is adapted for a drawer movement in and out of a corresponding drawer receiving opening 101 of a household appliance 200 described in FIG. 2.

FIG. 2 shows an example of an embodiment of a household appliance 200, especially a steam oven according to the present invention. The steam oven 200 comprises a cooking cavity 210 and a door 220 to close the cooking cavity during cooking operation.

A receiving opening 101 in form of a slot or other free space is shown inside of the cooking cavity 210 of the steam oven 200. A receiving opening 101 may be located at any desired location within the household appliance. The receiving opening is beneficially adapted to the size of the fluid container 110. A made to measure slot may be provided for that purpose. On the other hand in order to make efficient use of the heat in the cooking cavity 210 the fluid container 110 may only be supported partially in a receiving opening 101 e.g. by a sheet metal stripe. This also saves material while at the same time improving heat exchange. One major concern regarding its placement should be directed, however, to pick a location to avoid fluid contact with electronic components, while at the same time not reducing the space that is required for cooking.

Figure 3:
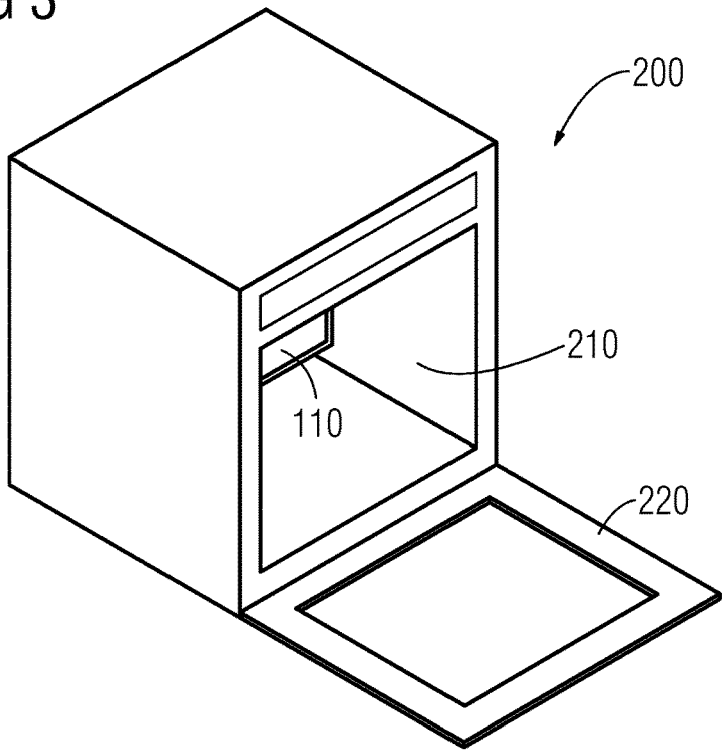
FIG. 3 shows an example of a household appliance in the form of a steam oven comprising the fluid supply according to FIG. 1.

FIG. 3 shows an example of an embodiment of a household appliance 200, especially a steam oven according to the present invention. The steam oven 200 comprises a cooking cavity 210 and a door 220 to close the cooking cavity during cooking operation.

A fluid container 110 is shown to be inserted inside of the cooking cavity 210 of the steam oven 200. The fluid container 110 may be inserted at any desired location within the household appliance into a receiving opening 101 beneficially adapted to its size. A respective slot may be provided for that purpose. One major concern regarding its placement should be directed, however, to pick a location to avoid fluid contact with electronic components, while at the same time not reducing the space that is required for cooking.

LIST OF REFERENCE NUMERALS

100 fluid supply
101 receiving opening
105 container lid
107 fill opening
110 fluid container
115 fluid communication part
120 support structure/frame
125, 130, 135, 140 flow obstacles
145, 150, 155 pairwise corresponding alignment structures
170 releasable obstacle structure
180 inclined surface on fluid container main body
160, 165 curved sidewall structure of the fluid container
200 household appliance, steam oven
210 cooking cavity
220 door for closing the cooking cavity

The invention claimed is:

1. A fluid supply for a household appliance, the fluid supply comprising:

a fluid container defining a fluid volume, the fluid container comprising a protrusion or notch extending inwards within the fluid volume;

a lid removably secured to the fluid container;

a fluid port to allow fluid transfer to the household appliance; and a flow obstacle assembly comprising a frame and at least two wave breakers that are connected to the frame and arranged serially spaced from each other inside the frame, the flow obstacle assembly being received and releasably supported within the fluid volume of the fluid container to obstruct fluid movement therein, wherein when the flow obstacle assembly is received within the fluid volume, the frame has an indentation that rests on and is supported by the protrusion or notch of the fluid container.

2. The fluid supply according to claim 1, said fluid port being releasable.

3. The fluid supply according to claim 1, wherein the lid and the fluid container comprise a mutual engaging guide for allowing translational movement of the lid with respect to the fluid container.

4. The fluid supply according to claim 1, wherein the lid or the fluid container comprises an opening for filling the fluid container.

5. The fluid supply according to claim 1, wherein the flow obstacle assembly is also supported on a bottom surface of the fluid container.

6. The fluid supply according to claim 1, wherein the flow obstacle assembly is also supported on a sidewall of the fluid container.

7. The fluid supply according to claim 6, wherein the flow obstacle assembly is supported on the protrusion of the fluid container.

8. The fluid supply according to claim 1, wherein a wall of the fluid container has a curved shape.

9. The fluid supply according to claim 1, wherein the fluid container has a longitudinal shape with parallel walls.

10. A household appliance with the fluid supply according to claim 1 releasably mounted inside of the appliance.

11. The household appliance according to claim 10, said appliance being a steam oven, said fluid supply configured to supply water for generating steam.

* * * * *